US005435037A

United States Patent [19]

Ledingham

[11] Patent Number: 5,435,037

[45] Date of Patent: Jul. 25, 1995

[54] PAINT BRUSH WITH REPLACEABLE BRISTLE PACK

[75] Inventor: Blake A. Ledingham, Vancouver, Canada

[73] Assignee: Terry R. Douglas, Surrey, Canada

[21] Appl. No.: 168,510

[22] Filed: Dec. 22, 1993

[51] Int. Cl.[6] ..... A46B 3/00

[52] U.S. Cl. ..... 15/168; 15/176.6; 15/177; 15/178; 15/193; 15/202; 15/204; 15/DIG. 4

[58] Field of Search ..... 15/147.1, 150, 159.1, 15/146, 168, 169, 171, 176.1, 176.4–176.6, 177, 178, 191.1, 192–194, 202, 204, 205, DIG. 4

[56] References Cited

U.S. PATENT DOCUMENTS

| | | | |
|---|---|---|---|
| 134,745 | 1/1873 | Gorman | 15/177 |
| 235,841 | 12/1880 | Wright | 15/204 |
| 389,657 | 9/1888 | Kimbler | 15/177 |
| 540,824 | 6/1895 | Webb et al. | 15/178 |
| 589,052 | 8/1897 | Watts | 15/171 |
| 704,483 | 7/1902 | Mansfield | 15/178 |
| 719,227 | 1/1903 | Johnson | 15/204 |
| 828,540 | 8/1906 | DeVere | 15/177 |
| 871,494 | 11/1907 | Foss | 15/204 |
| 964,707 | 7/1910 | Stevens | 15/205 |
| 999,307 | 8/1911 | Holcombe | 15/178 |
| 1,033,272 | 7/1912 | Rowe | 15/194 |
| 1,198,167 | 9/1916 | Stoltz | 15/178 |
| 1,449,901 | 3/1923 | Knapp | 15/177 |
| 1,499,507 | 7/1924 | Crummett et al. | 15/177 |
| 1,649,490 | 11/1927 | Schalle | 15/202 |
| 2,326,879 | 8/1943 | Neuhausen | 15/202 |
| 2,419,899 | 4/1947 | Kantor | 15/178 |
| 2,558,290 | 6/1951 | Brown et al. | 15/202 |
| 2,712,145 | 7/1955 | Karnes | 15/202 |
| 2,737,678 | 3/1956 | Van Clief, Jr. et al. | 15/202 |
| 2,785,427 | 3/1957 | Bury | 15/202 |
| 2,900,654 | 8/1959 | Koltvedt | 15/176.6 |
| 2,912,709 | 11/1959 | Carlson et al. | 15/178 |
| 2,943,341 | 7/1960 | Dant | 15/202 |
| 2,948,910 | 8/1960 | Hulla | 15/159.1 |
| 3,090,063 | 5/1963 | Weiss et al. | 15/193 |
| 3,131,419 | 5/1964 | Vosbikian et al. | 15/150 |
| 3,155,998 | 11/1964 | Hardman et al. | 15/192 |
| 3,263,259 | 8/1966 | Shulman | 15/193 |
| 3,783,468 | 1/1974 | Saloutos | 15/202 |
| 4,129,918 | 12/1978 | Lee | 15/169 |
| 4,237,579 | 12/1980 | Salmon | 15/166 |
| 4,339,837 | 7/1982 | Reeberg | 15/169 |
| 4,494,268 | 1/1985 | Chu | 15/202 |
| 4,887,327 | 12/1989 | Meimeteas | 15/168 |

FOREIGN PATENT DOCUMENTS

| | | | |
|---|---|---|---|
| 497801 | 12/1950 | Belgium . | |
| 182819 | 3/1918 | Canada . | |
| 714282 | 9/1931 | France . | |
| 894974 | 1/1945 | France | 15/176.6 |
| 2428418 | 2/1980 | France | 15/176.1 |
| 2624766 | 6/1989 | France | 15/176.1 |
| 916406 | 7/1954 | Germany | 15/202 |
| 429280 | 1/1948 | Italy | 15/194 |
| 86543 | 9/1920 | Switzerland | 15/178 |
| 606536 | 8/1948 | United Kingdom | 15/202 |
| 886285 | 1/1962 | United Kingdom | 15/202 |

*Primary Examiner*—Mark Spisich
*Attorney, Agent, or Firm*—Oyen Wiggs Green & Mutala

[57] ABSTRACT

This invention pertains to a paint brush with a replaceable bristle pack. A unitary paint brush with replaceable bristles comprising: (a) a paint brush body and handle, the body having formed in one end thereof opposite the handle a cavity adapted for receiving a group of bristles; (b) at least one releasable member secured to one side of the paint brush body, and projecting over the cavity, the releasable member being capable of abutting the bristles when moved to a first closed position, and being removed from the bristles when moved to a second open position; (c) at least one movable securing member for securing the hinged releasable member in a first position and releasing the hinged releasable member for movement to a second open position; and (d) a group of bristles held together and located within the cavity of the holder, and held in place by the hinged releasable member, said bristle group being removable and secured in place by the releasable mender.

15 Claims, 10 Drawing Sheets

PAINT BRUSH WITH REPLACEABLE BRISTLE PACK

FIELD OF THE INVENTION

This invention pertains to a paint brush with a replaceable bristle pack. More particularly, this invention is directed to a paint brush in which the bristles which have dried paint bristle build-up and bristle spread, both of which occur after paint brushes have been used and re-used for a period of time, can be removed and replaced with a new bristle pack, thereby prolonging the life of the paint brush.

BACKGROUND OF THE INVENTION

A longstanding problem with paint brushes that are used for industrial and domestic painting applications is that with time and repeated use paint tends to buildup within the bristles at the end of the bristles that is joined to the paint brush handle and base. The bristles are typically held in place with rigid urethane glue which is bonded to a ferrule connected to the brush handle. The paint which collects in that area of the bristles is difficult to clean away. Thus some paint is usually left in the bristles in that region of the brush even after the used brush has been cleaned. The dried paint collects and builds up over time with repeated use of the paint brush. This causes the bristles of the brush to spread and reduces the efficiency of the brush. Also, the dried paint buildup tends to cause the bristles to wear and break at the location of the dried paint. This reduces the life of the paint brush.

The time required to clean conventional brushes is an important factor for commercial painters. In some instances, it can be more economical for commercial painters to discard brushes after each use rather than spend the time to clean them properly. This results in unnecessary wastage.

It would be advantageous if some means could be developed which would prolong the life of a paint brush handle and enable the bristles to be replaced.

U.S. Pat. No. 4,129,918, granted Dec. 19, 1978, to Robert Lee, discloses an adjustable sleeve for an artist's paint brush adapted to adjust the effective length of the bristles of the brush. The adjustable sleeve is tubular at its tip to contain the hair or bristles. The sleeve is split above the tip to provide a spring biased grip upon the brush ferrule. The adjustable sleeve is tapered in substantial conformity with the taper of the ferrule and it is longitudinally adjustable relative to the ferrule to vary the effective length of the hair or bristles. The sleeve is designed for use with an artist's brush, which has bristles arranged in a taper column form. Lee does not disclose a mechanism whereby the bristles of a used paint brush can be replaced with new bristles.

U.S. Pat. No. 4,237,579, issued Dec. 9, 1980, to Jonathan H. Salmon, discloses a tool for applying a liquid stain to a flat surface to impart a timber grain effect to the surface. The tool comprises a paint brush, a bristle retaining slidable plate on one side of the brush and a slidable comb plate on the other side of the brush. Both of the plates have an elongated slot which engages a bolt which passes through the paint brush. The comb adjustably separates the brush bristles into discrete bunches to permit the application of stain to impart a wood grain pattern to the surface. This tool does not disclose a holder which fits on both sides of the paint brush base where the bristles are secured to the base.

The tool also does not disclose a mechanism which enables used bristles to be replaced with new bristles, while retaining the handle.

U.S. Pat. No. 4,339,837, granted Jul. 20, 1982, to Christian Reeberg, discloses a sliding box-like girdle which can be fitted over a paint brush to confine the bristles. The girdle acts as a hanger so that the paint brush can be hung on a wall. The girdle also protects the brush bristles while on display, or during storage. Further, the girdle is used to control the effective length of the bristle ends for specific painting jobs. The girdle also serves to squeeze excess paint from the bristles after each dip into a can of paint. The girdle does not serve to encircle the base of the paint brush, where the bristles meet the paint base, or a mechanism whereby used bristles can be replaced with new bristles.

SUMMARY OF THE INVENTION

The invention is directed to a unitary paint brush with replaceable bristles comprising: (a) a paint brush body and handle, the body having formed in one end thereof opposite the handle a cavity adapted for receiving a group of bristles; (b) at least one releasable member secured to one side of the paint brush body, and projecting over the cavity, the releasable member being capable of abutting the bristles when moved to a first closed position, and being removed from the bristles when moved to a second open position; (c) at least one movable securing means for securing the hinged releasable member in a first position and releasing the hinged releasable member for movement to a second open position; and (d) a group of bristles held together and located within the cavity of the holder, and held in place by the hinged releasable member, said bristle group being removable and secured in place by the releasable member.

The paint brush can include a pair of hinged releasable members which can be elongated planar flaps, and can be respectively hinged along each side to the body, adjacent the cavity, and a pair of moveable securing means. The edges of the planar flaps removed from the sides of the flaps that are hinged to the body can have reinforcing clips secured thereto. The movable securing means can be springs which pivot relative to the pair of flaps, and when pivoted to a first position, close the flaps against the bristles, and when pivoted to a second open position, enable the flaps to be moved away from the bristles.

A bristle separator which separates the bristles into two groups can be located in the cavity between the pair of hinged releasable members. The removable bristles and the separator can be glued together at an end which is held in the interior of the cavity.

The bristle separator can be secured to the end walls of the cavity between the respective hinged releasable members. The bristle separator can have a series of openings along one side thereof, said openings being adapted to enable glue to pass from one side of the bristle separator to the opposite side of the bristle separator, and hold the separator in place in the interior of the bristles.

A hook can be installed in the body of the paint brush, the hook being adapted to enable the paint brush to be hooked onto a paint can. The movable securing means can be metal springs.

The pair of hinged side flaps can have connectors which enable the side flaps to be connected with end flaps which are formed between the side flaps, When the side flaps are in a closed position, said end flaps being connected to the paint brush body.

The invention is also directed to a paint brush with replaceable bristles comprising: (a) a paint brush body and handle, the body having formed in one end thereof opposite the handle a cavity adapted for receiving a group of bristles; (b) a group of bristles held together and located within the cavity of the body; (c) at least one securing means for releasably securing the group of bristles within the cavity.

A bristle separator which separates one end of the bristles into two groups can be located in the cavity of the paint brush body. The removable bristles and the separator can be glued together at an end which is held in the interior of the cavity. The bristle separator and the bristles can be secured within the cavity by a removable pin.

The bristle separator can have a series of openings along one side thereof, said openings being adapted to enable glue to pass from one side of the bristle separator to the opposite side of the bristle separator, and hold the separator in place in the interior of the bristles. The separator can be removably connected to the body of the paint brush, by at least one tongue and groove combination.

The bristle securing means can be a clamp which removably fits about at least a portion of the paint brush body. The clamp can be constructed of two releasably interlocking components.

BRIEF DESCRIPTION OF THE DRAWINGS

In drawings which illustrate specific embodiments of the invention, but which should not be construed as restricting the spirit or scope of the invention in any way.

DETAILED DESCRIPTION OF SPECIFIC EMBODIMENTS OF THE INVENTION

Figure 1:
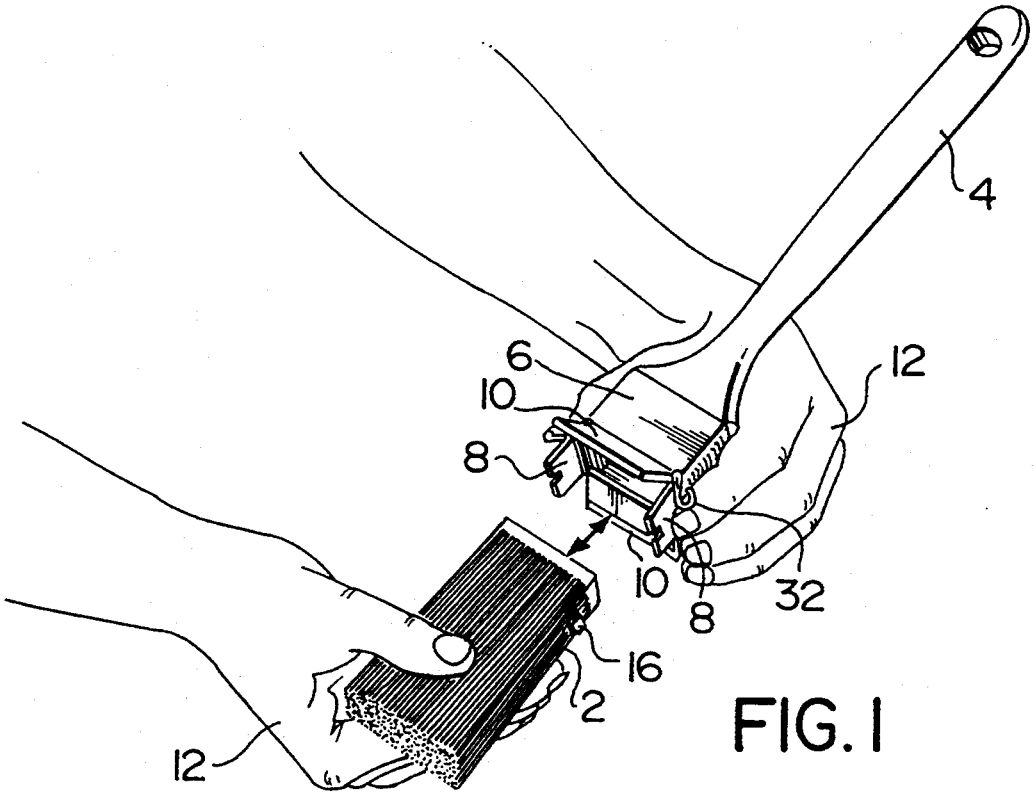
FIG. 1 illustrates a perspective view of the removable bristle pack being removed from a paint brush handle by a pair of hands.

Referring to the drawings, FIG. 1 illustrates a perspective view of the removable bristle pack being removed from a paint brush handle by a pair of hands. As seen in FIG. 1, the removable bristle pack 2 fits into the open end of a paint brush 4 with ferrule 6, a pair of end flaps 8 and a pair of hinged side flaps 10. As seen in FIG. 1, the bristle pack 2 is being separated from the brush 4 by a pair of hands 10.

Figure 1A:
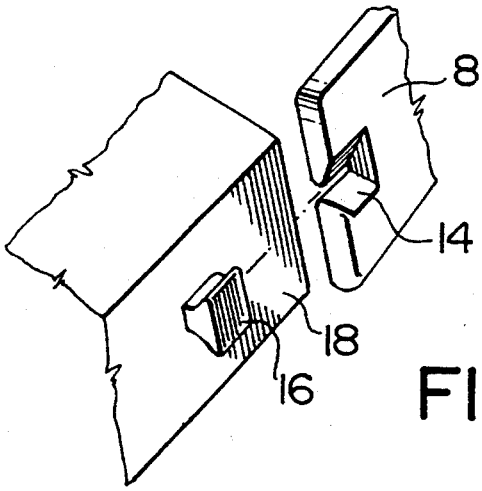
FIG. 1*a* illustrates an enlarged perspective detail of the joint between the side flap and the midsection.

FIG. 1*a* illustrates an enlarged perspective detail of the joint between the side flap and the mid-section. FIG. 1*a* shows in particular the detail of the V-shaped groove 14 in end flap 8 and tongue 16 of the mid-section. 18.

Figure 2:
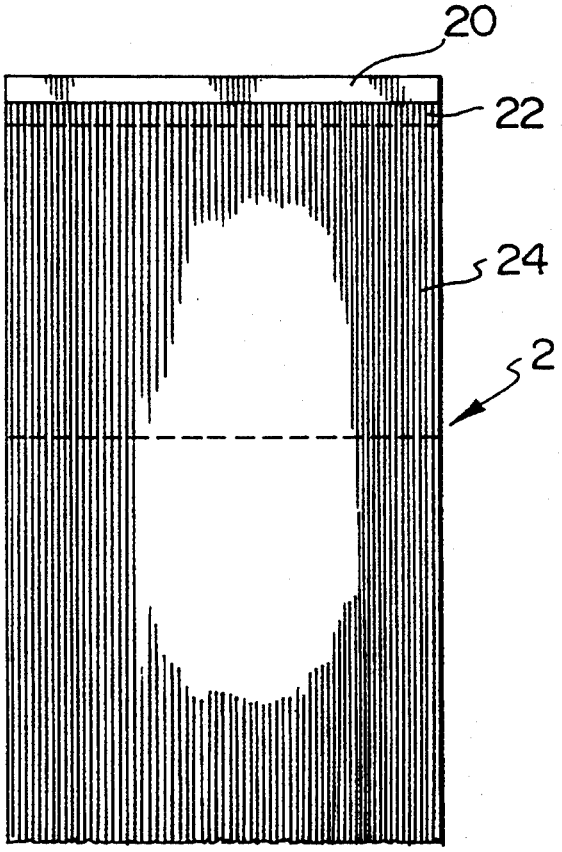
FIG. 2 illustrates a front elevation of the removable bristle pack.
Figure 3:
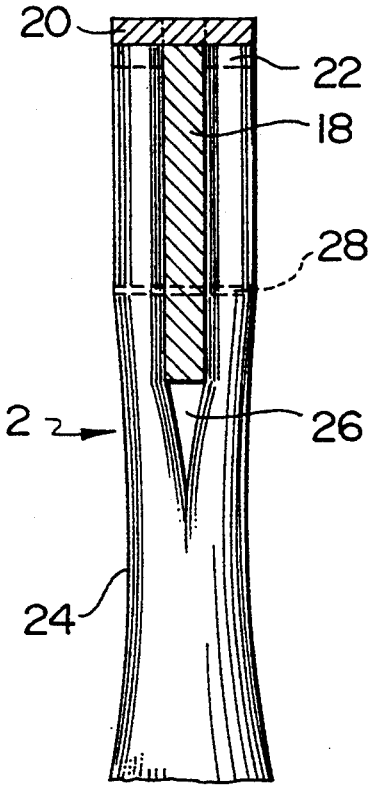
FIG. 3 illustrates a side elevation of the removable bristle pack.

FIG. 2 illustrates a front elevation of the removable bristle pack. FIG. 2 illustrates the construction of the bristle cluster 24 bound together at the top by glue head 20 which penetrates into the bristles 24 in penetration zone 22. FIG. 3 illustrates a side elevation of the removable bristle pack. FIG. 3 illustrates the glue head 20 holding the top of the bristles 24 and the mid-section 18 together by penetration zone 22. The bottom of the mid-section 18 leaves a cavity 26, which is useful to hold extra paint in the bristles 24.

Figure 4:
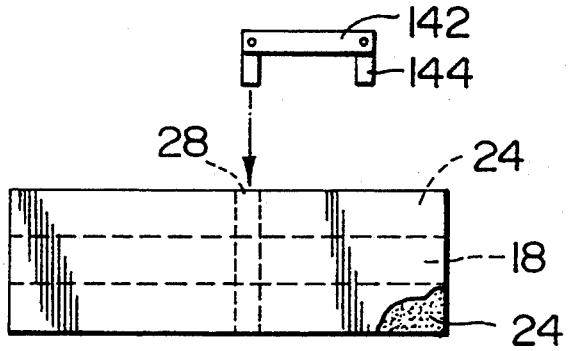
FIG. 4 illustrates a plan view of the removable bristle pack.

FIG. 4 illustrates a plan view of the removable bristle pack. FIG. 4 illustrates the mid-section 18 separating the bristles 24 into two separate sections. A securing hole 28 (see also FIG. 3) penetrates through the bristles 24 and the mid-section 18. A removable pin 142 with hinged end pieces 144 fitting into securing hole 28 for the purpose of securing a pack of bristles 24 into a paint-brush handle is al so illustrated (see FIG. 28 for further details).

Figure 5:
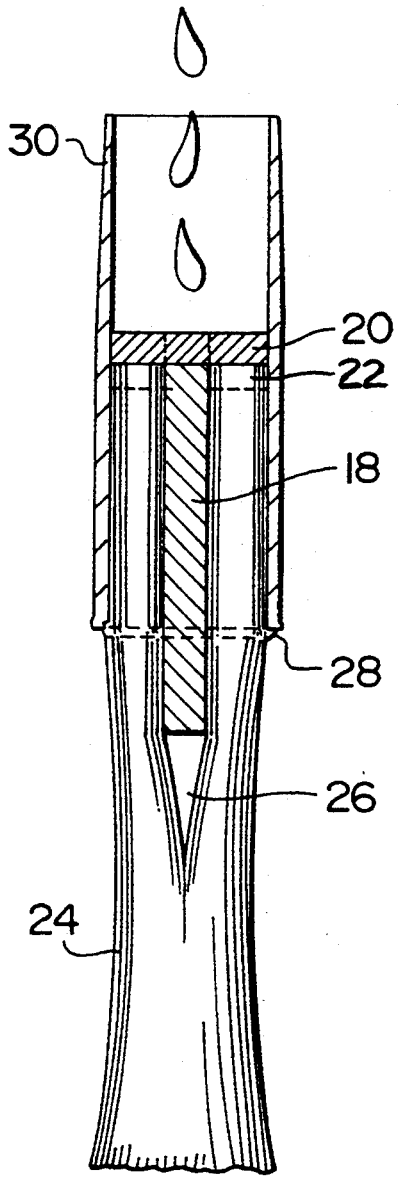
FIG. 5 illustrates a side-section view of bristles being held in a mold being glued.

FIG. 5 illustrates a side-section view of bristles being held in a mold being glued. As shown in FIG. 5, the bristles 24 and mid-section 18 are held in position in a mold 30, which can be clamped to hold the two groups of bristles 24 and mid-section 18 together. Glue (shown as drops) is then poured in the top of the mold 30 to form glue head 20, which penetrates into the tops of the bristles 24 as indicated by glue penetration zone 22. Once the glue head 20 hardens, the bristles 24 and mid-section 18 are held securely together. The glue head 20 can be any suitable solvent resistant glue, but epoxy glue, whose set rate can be adjusted to production times, is well-suited for this application. The securing hole 28 is formed in the mid-section 18 prior to assembly with the bristles 24 mold 30.

Figure 6:
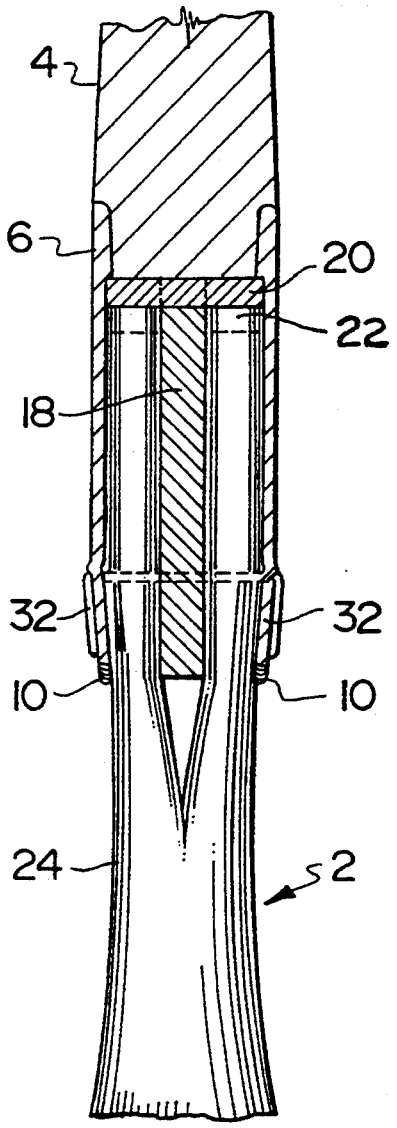
FIG. 6 illustrates a side-section view of the removable bristle pack held in a paint brush handle.

FIG. 6 illustrates a side-section view of the removable bristle pack held in a paint brush handle. FIG. 6 illustrates the removable bristle pack 2 held in place by ferrule 6 on handle 4. The lower end of the ferrule 6 is equipped with side flaps 10 which can be closed against bristles 24 and mid-section 18 by rotatable clamps 32 (see also FIG. 1). When it is required to remove the bristle pack 2, the clamps 32 are rotated open, the flaps 10 are swung open and the bristle pack 2 withdrawn.

Unlike conventional paint brushes, which typically are constructed of a wooden handle, a ferrule, a bristle separating member, nails, and bristles, the main components of the subject unitary paint brush bristle holder are formed primarily of one piece.

Figure 7:
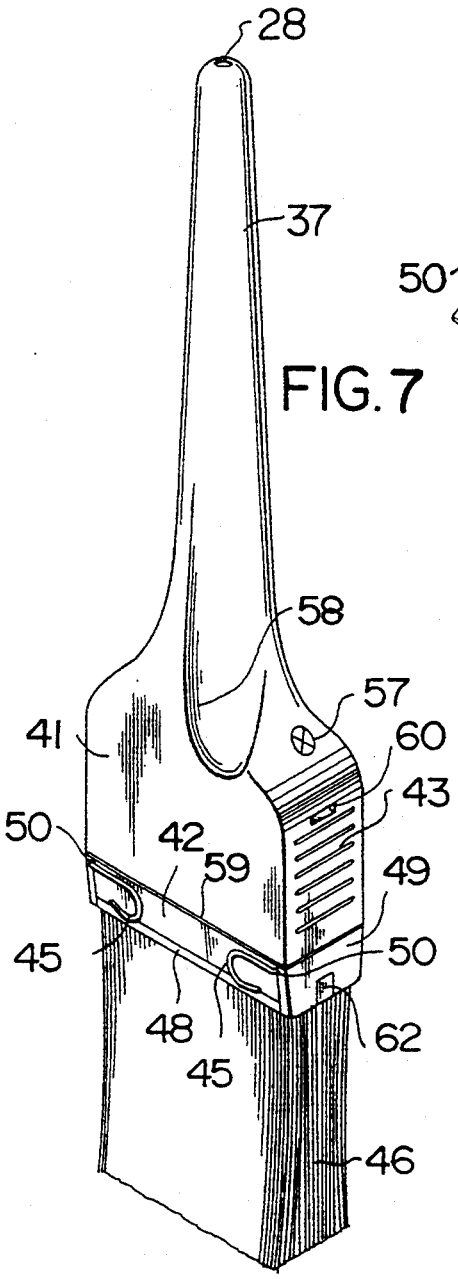
FIG. 7 illustrates an isometric view of a unitary paint brush and removable bristle pack holder.

FIG. 7 illustrates an isometric view of the unitary paint brush, handle, base and bristle holder. The main component of the unitary paint brush comprises a handle 37 which melds smoothly with the plastic body 41, which is typically formed from injection molded polypropylene or polyethylene. The body 41 has on each longitudinal side thereof, at the end opposite the handle 37, a pair of hinged bristle compressing flaps 42. Finger grips 43 are located on each narrow lateral side of the body 41. The hinged flaps 42 are held in place by rotatable springs 45 which, in a closed position, hold the flaps 42 against the bristles 46, and which, when swung to the side, release the flaps 42 so that they can be pivoted outwardly away from the bristles 46. There are two springs 45 per body 41. Each spring 45 has a U-shape, with curled ends. The hinge line for the flap 42 is indicated by hinge line 59. The free edges of the two hinged flaps 42 are reinforced with respective stainless steel U clips 48, which provide dimensional stability to the edge of the flap 42, thereby resisting bending when the flaps 42 are folded against the bristles 46. Grooves 50 are formed at each end of the flap 42, in line with the hinged edge 59. These grooves 50 accommodate the transverse part of the rotatable springs 45. End flaps 49 are located below the finger grips 43, on the narrow lateral sides opposite the handle 37.

Also seen in FIG. 7 are a breathing hole 60, at the end of the handle 37, removed from the body 41. The hole 60 permits moisture to escape from the interior of the handle 37 when the handle 37 and body 41 are being molded. An ergonomic finger groove 58 is formed in the handle 37, in the region where it meets with the body 41. This groove 58 improves grippability of the handle 37. The body 41, on the narrow lateral sides, in the region where the body 41 melds with the handle 37, includes a pair of optional heart valves 57. These optional valves can be used for glue injection when the bristles 46 are being installed in the body 41. This may be the case where it is preferred to manufacture the removable bristle pack along with the unitary paint brush handle 37.

Figure 8:
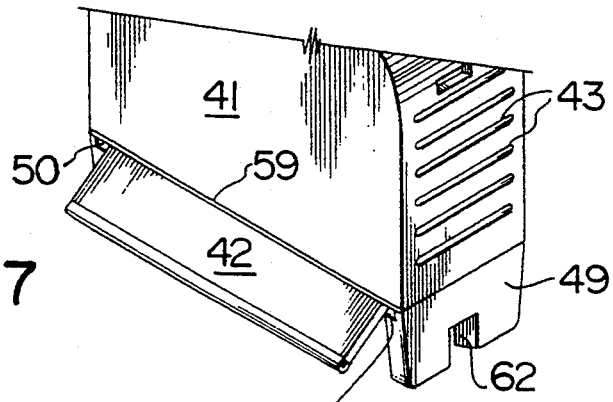
FIG. 8 illustrates a detailed isometric view of a portion of the unitary paint brush and removable bristle pack holder.

FIG. 8 illustrates an isometric detailed side view of the body 41 and flap 42 of the unitary paint brush and bristle holder. As seen in FIG. 8, flap 42 has been pivoted upwardly away from end flap 49. The groove 50 for the lateral part of spring 45 is visible clearly in FIG. 8. The flap 42 pivots away from the end flap 49, and the bristles (not shown), along hinge line 59. Also seen in FIG. 8 is female wedge groove opening 62, which is adapted to receive the tongue of a mid-section 61 (not shown), which will be discussed later in association with FIG. 12 to 14.

Figure 9:
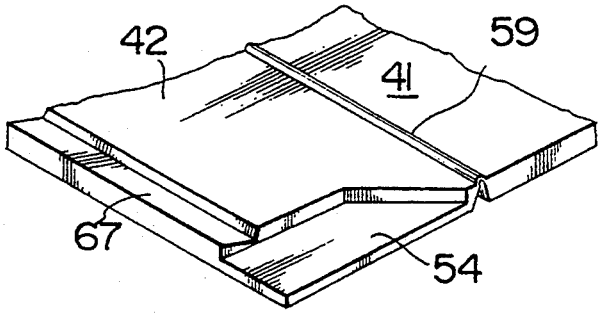
FIG. 9 illustrates a detailed isometric view of the flap of the unitary paint brush and removable bristle pack holder.

FIG. 9 illustrates an isometric detailed view of the corner of the flap 42, hinge line 59 and body 41 combination. The free end of the flap 42, at the edge away from the hinge line 59, has formed therein along its length a clip depression 67, which is adapted to receive the stainless steel reinforcing U clip 48 (see FIG. 7). The corner of the flap 42 is recessed to form depression 54, which is adapted to receive spring 45, when the spring 45 is rotated to a closed position whereby the flap 42 is pressed against the bristles (not shown but see FIG. 7).

Figure 10:
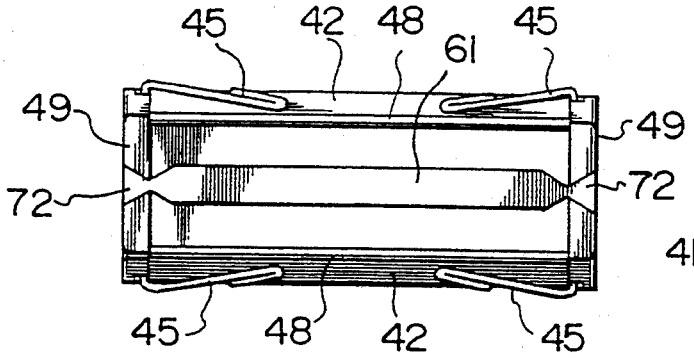
FIG. 10 shows an end view of the base of the unitary paint brush, bristle holder and mid-section.

FIG. 10 illustrates an end view of the unitary paint brush and bristle holder, without the bristles. The pair of stainless steel reinforcing U clips 48 extend along each longitudinal side of the flaps 42. As seen in FIG. 10, the flaps and clips 48 are in a closed position, with the four rotatable springs 45 moved to respective closed positions. End flaps 49 extend along the edge of each narrow lateral side of the bristle holder. Located between the two flaps 42 and clips 48, at mid-point, and parallel therewith, is a removable mid-section 61. Mid-section 61 is formed to have at each end a pair of wedge-shaped tongues 72, which fit within the respective wedge-shaped opening 62 in the end of respective end flaps 49 (see FIG. 8). While not shown in FIG. 10, the bristles 46 are mounted in two groups in the spaces formed between mid-section 61 and the adjacent parallel flaps 42 and clips 48.

Figure 11:
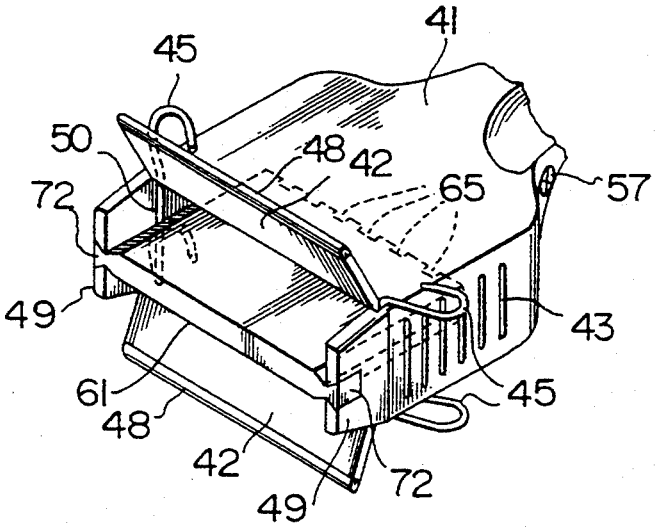
FIG. 11 illustrates an isometric view of the base of the unitary paint brush, bristle holder and mid-section.

FIG. 11 illustrates an isometric view of the end of the unitary paint brush and bristle holder 41, before the bristles are installed in the two spaces formed between the pair of flaps 42, part of-the body 41, and the mid-section 61. As seen in FIG. 11, the two springs 45 have been moved to respective open positions, and the pair of flaps 42 with U clips 48 are hinged away from the respective end flaps 49 along hinge line 59. Mid-section 61 can be seen mounted between end flaps 49, and held in place by respective tongue and groove wedges 62 and 72. Finger grips 43 are also shown on the one visible narrow lateral side of the body 41. In the position illustrated in FIG. 11, the unitary paint brush bristle and holder is adapted to receive the insertion of the bristle plug comprising two bunches of bristles 46 (not shown but see FIG. 7) in the respective openings existing between the central mid-section 61 and the exterior adjacent flaps 42, and the interior of body 41, formed on either side of mid-section 61. Once the bristle plug is installed, the bristles are held in place by closed flaps 42 and springs 45.

Figure 12:
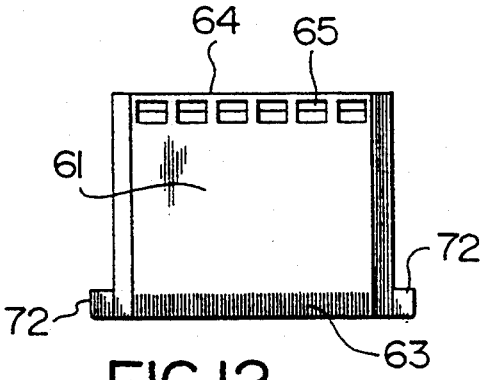
FIG. 12 illustrates a front view of the removable mid-section of the removable bristle pack.

FIG. 12 illustrates a detailed front view of the construction of the mid-section 61. The mid-section 61 is generally rectangular in construction, and planar. A pair of tongue wedge inserts 72 are formed at the two bottom corners. These two wedges 72 fit respectively within the wedge openings 62 which are formed in the two end flaps 49 of the body 41 (see FIG. 7). A series of striations 63 are formed along the edge of mid-section 61, between the pair of tongue wedges 72. These striations 63 help hold the adjacent bristles 46 (not shown but see FIG. 7) and prevent the bristles from wiggling back and forth when the brush is being used. On the side of the mid-section 61 opposite the striations 63, there are formed a series of openings 65, which serve to permit glue, such as epoxy glue, to pass from one side to the other side of mid-section 61. A narrow bar 64 passes across the open edges of the openings 65. This bar 64 serves to grip the glue after it hardens, thereby deterring the removal of mid-section 61 from bristles 46, once glue is in place. If bar 64 were not present, and the openings 65 were thus open-ended, it is possible that with use the mid-section 61 could be pulled away from the glue head 20 (see FIG. 2) which holds the bristle base in place within the interior of the paint brush body 41.

Figure 13:
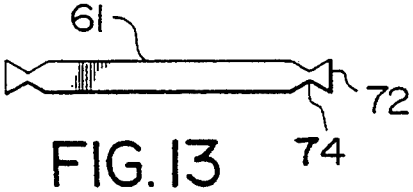
FIG. 13 illustrates an end view of the mid-section of the removable bristle pack.
Figure 14:
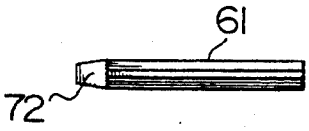
FIG. 14 illustrates a side view of the mid-section of the removable bristle pack.

FIG. 13 illustrates an end view of the mid-section 61, and in particular, the construction of the pair of wedges 72 at each end. The locations 74 where the pair of wedges 72 join with the main body of the mid-section 61 are narrow to correspond with the tapered shape of the wedge openings 62 formed in end flaps 49. This construction prevents the pair of end flaps 49 from flaring away from mid-section 61, when pressure is applied to the paint brush bristles. FIG. 14 illustrates a detailed end view of the mid-section 61 and the wedge 72.

Figure 15:
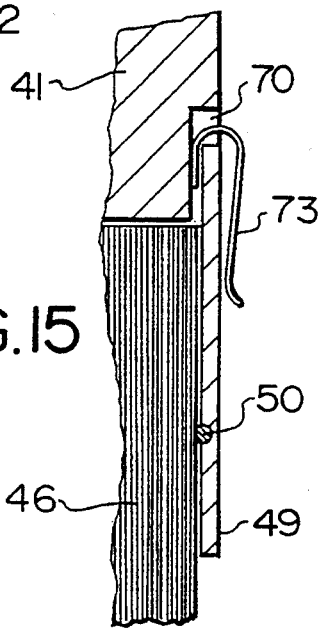
FIG. 15 illustrates a partial section-side view of a removable bristle pack paint brush with a hook.

FIG. 15 illustrates a front partial section view of a portion of the paint brush body 41 and end flap 49, equipped with a hook 73. This hook 73 is optional and fits in opening 70, formed in body 41 (see also FIG. 7). The hook 73 enables the paint brush to be conveniently hooked onto the edge of a paint can. Often, it is difficult to find a location to lay down a wet paint brush. Laying the paint brush along the edge of the top of a can sometimes causes an accident where the brush either falls into the interior of the can, or gets knocked off and falls onto the floor, thereby putting unwanted paint on the floor.

Figure 16:
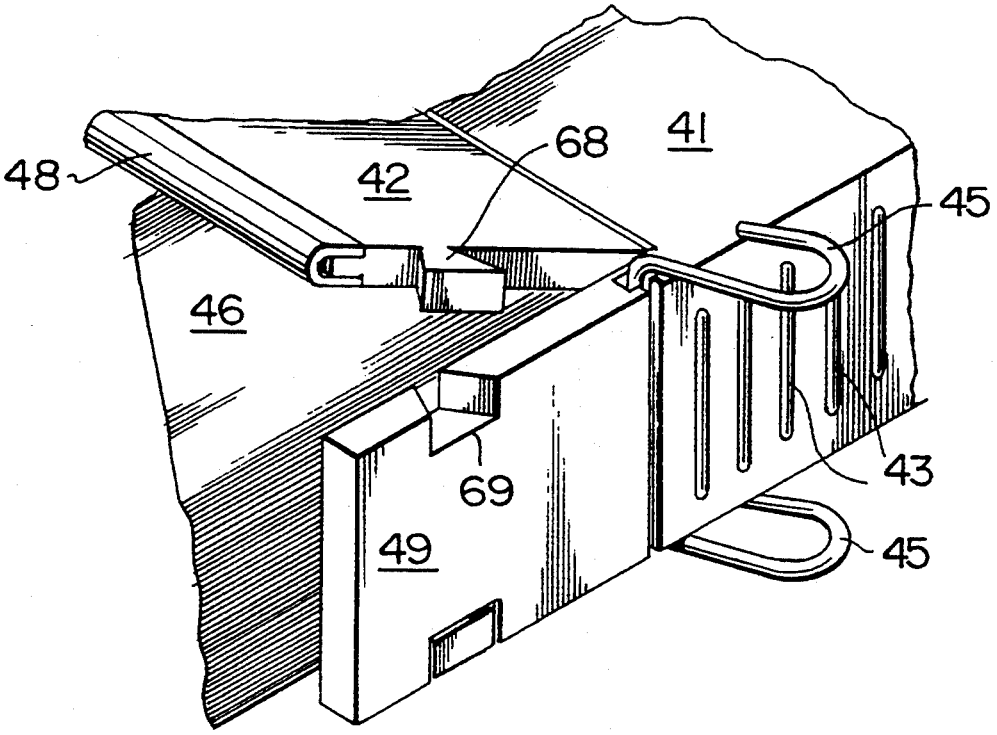
FIG. 16 illustrates an enlarged isometric view of a unitary paint brush and removable bristle pack without a mid-section.

FIG. 16 illustrates an isometric detailed view of an alternative embodiment of brush. The mid-section 61 is optional. In less expensive versions, it is not necessarily to have a mid-section present in the unitary paint brush and bristle holder. If the mid-section 61 is absent, tongue wedges 68 can be formed in the ends of the flaps 42, which are adapted to mate with corresponding wedge-shaped recesses 69 in the sides of end flaps 49, thereby enabling the flaps 42 to unite with the end flaps 49, when the springs 45 are moved into place. This configuration is illustrated in FIG. 16.

A major advantage of the unitary paint brush is that it can be quickly and economically injection molded in one piece, thereby eliminating the need to have a separate ferrule, and a separate handle. The unitary brush is therefore more economical to produce in mass quantities.

Another major advantage is that when the pair of flaps 42 are forced against the bristles 46 by moving springs 45 into a closed position, the solid paint particles in the paint emulsion coating the bristles 46 are prevented from migrating along the bristles past the reinforcing U clip edges 48. While the liquid medium of the paint emulsion may migrate by capillary action along the bristles 46, and past the pair of flaps 42, the solids in the emulsion are effectively stopped at the point of pressure under the edge of the pair of U clips 48. A liquid solid separation therefore takes place in the region of each flap 42 and U clip 48. When it is time to clean the paint brush, the springs 45 are rotated into open positions, the pair of hinged flaps 42 are pivoted away from the bristles 46, and the portion of the bristles which has not been coated with solid paint are exposed for cleaning with a paint solvent. The interrupted solids are openly exposed on the bristles 46, at an intermediate point, and are not accumulated against the base of the bristles. The solvent can be either a petroleum distillate, which is normally used for cleaning oil-based paint brushes, or water, which is used to remove water soluble latex-based paints.

Tests which have been conducted with a prototype indicate that the bristles 46 can be completely cleaned using only about 10 to 20 percent of the amount of solvent that is normally used to clean a conventional paint brush. Much of the solvent in a conventional case is consumed by endeavouring to clean away the collected and coagulated paint solids, which typically form and collect at the base of the bristles, where they joint the ferrule in a conventional paint brush. Another advantage of a unitary paint brush design, with hinged end flaps 42, is that the paint particles are prevented from contacting the junctions where the bristles meet the brush handle, or ferrule, where they tend to dry and stiffen. The dried paint causes flex points which force the bristles to bend at those points, eventually leading to breakage of the bristles.

Because there is no build-up of paint solids within the bristles 46, the region where the bristles 46 are set into the interior of the body 41 remains clear and flexible, and accordingly bristle flare and bristle wear are avoided or minimized. A longstanding problem with conventional paint brushes is that the performance of the paint brush is proportionately reduced with the build-up of clogged dry paint at the base regions of the bristles. This does not occur in the applicant's unitary paint brush construction because the flaps 42 can be moved away from the bristles 46 to expose the bristles for ready cleaning. It is only when the paint brush is being used that the flaps 42 are closed against the bristles 46 by moving springs 45 into a closed position.

Figure 17:
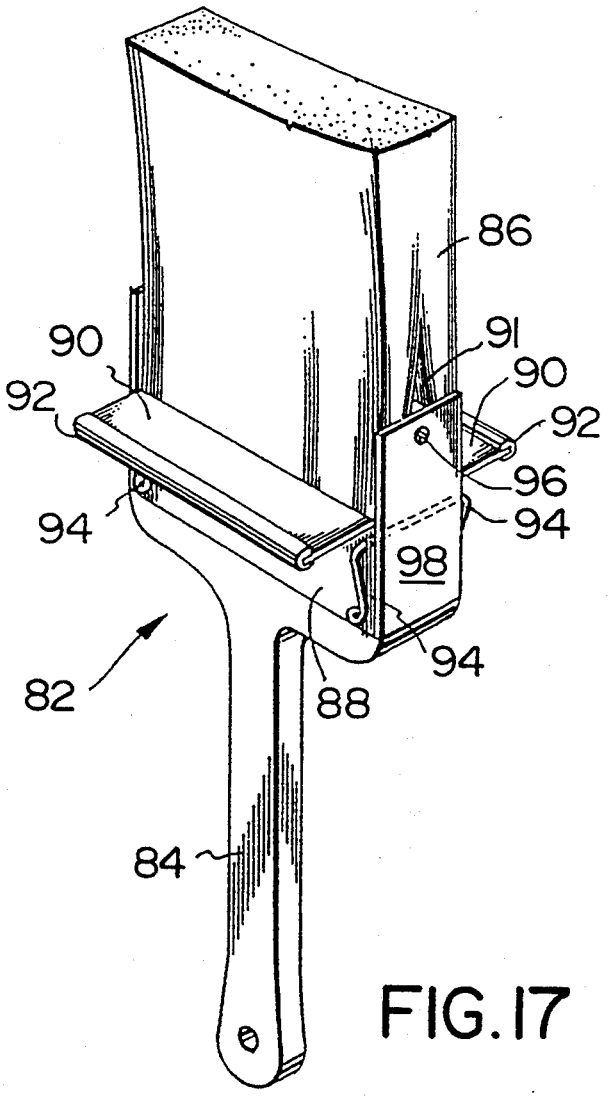
FIG. 17 illustrates an isometric view of a paint brush with the removable bristle pack held by a bristle holder.

FIG. 17 illustrates an isometric view of a multi-piece paint brush 82, handle 84, and removable bristle pack 86, equipped with a ferrule-type bristle holder 88. The bristle holder 88 has on each side a hinged panel 90, which extends laterally along the wide side of the holder 88. The edge of each hinged panel 90, removed from the bristle 86, has thereon a respective reinforcing clip 92. Reinforcing clip 92 is usually formed of stainless steel and serves to provide dimensional stability to the hinged panel 90 when the hinged panel 90 is hinged upwardly so that it abuts the removable bristle pack 86. The bristle holder 88 is a clip with a pair of securing clips 94, which in FIG. 17 are shown hinged downwardly to thereby enable the pair of panels 90 to be moved away from the removable bristle pack 86. In this position, the bristle pack 86 can be removed and replaced with a new bristle pack. A screw or pin 96 fits in the narrow side of the holder 88, and holds a bristle mid-section (not visible in FIG. 17) which extends laterally across the interior of the holder 88. The bristle mid-section forms a space 91 between one group of bristles on one side of the holder, and another group of bristle 86 on the other side of the holder 88.

Figure 18:
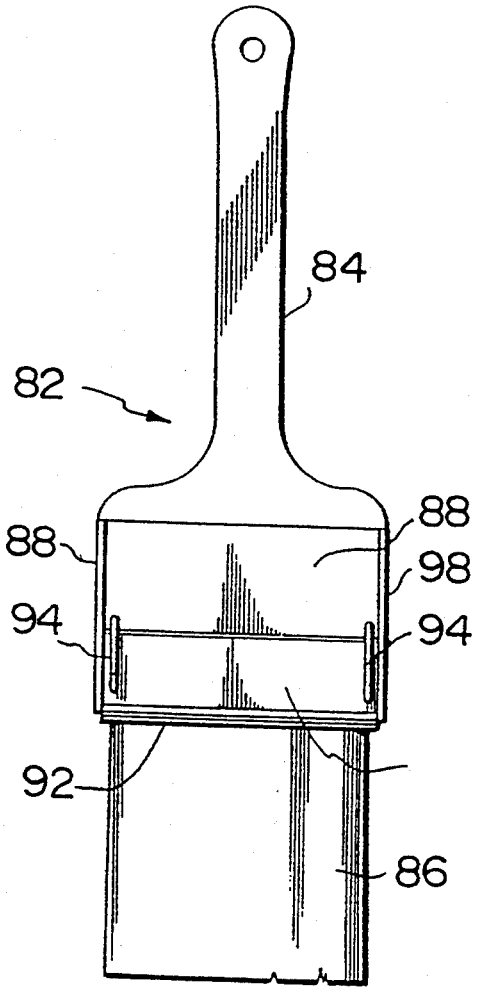
FIG. 18 illustrates a front view of a paint brush with a removable bristle pack held by a bristle holder.

FIG. 18 illustrates a front view of the paint brush 82, with handle 84 and removable bristle pack 86. As seen in FIG. 18, hinged panel 90 has been moved so that it abuts the bristle pack 86, and is held in place by the pair of securing clips 94 being snugged into position to hold the panel 90 against the removable bristle pack 86. In this position, the bristle pack 86 cannot be removed if the pin 96 is removed. FIG. 18 also illustrates how the reinforcing clip 92, constructed of hardened steel, strengthens the edge of the panel 90 and thereby ensures that a firm force is applied against the bristle pack 86 along the entire edge of the panel 90. FIG. 18 also illustrates holder end piece 98, which extends along the narrow side of each end of holder 88.

Figure 19:
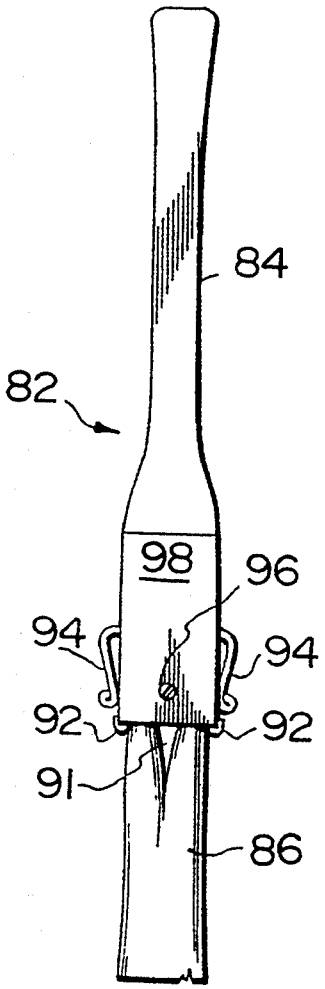
FIG. 19 illustrates a side view of a paint brush with the removable bristle pack held by a bristle holder.

FIG. 19 illustrates an end view of the paint brush 82, with handle 84 and removable bristle pack 86. As seen previously in FIG. 18, FIG. 19 also illustrates the pair of hinged panels 90 moved into position so that they abut the bristles 86 of the bristle pack, and are held in place by securing clips 94. Holder end piece 98 is fully visible in FIG. 19. Screw or pin 96, which extends the length of holder 88, holds the two holder end pieces 98 together, as well as bristle mid-section separator (which is not visible in FIG. 19) of the bristle pack 86. The bristle mid-section separator 18, which is part of the removable bristle pack 2, discussed previously in relation to FIG. 1, creates a space 91 between one group of bristles 86 and the opposite group of bristles. The first and second group of bristles and the mid-section separator are held together by glue as shown in FIGS. 2 to 4.

Figure 20:
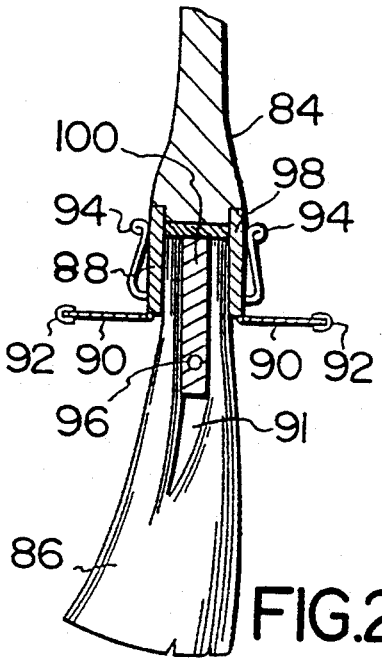
FIG. 20 illustrates an end section view of the removable bristle pack and bristle holder with the side gripping plates hinged away from the bristles.

FIG. 20 illustrates a section end view showing how the movable bristle pack 86 is arranged in two groups of bristles and fits along with mid-section separator 100 into the interior of holder 88. As seen in FIG. 20, the pair of hinged panels 90 are hinged away from the bristle packs 86. Bristle separator 100, which is held in place by screw-or-pin 96, separates the bristles into two groups, leaving space 91 between the two groups. Clips 94 have been swung away so that panels 90 can be moved away from the bristle pack 86.

The orientation depicted in FIG. 20 is suitable for enabling the removable bristle pack 86 to be inserted into holder 88 and fully clamped. By moving the two hinged panels 90 away from the bristle pack 86, the bristle pack 86, which has become coated with paint, can be removed and exposed to solvent for cleaning. Alternatively, if the bristle pack 86 is too clogged with hardened paint, and is thus ineffective for further use, it can be removed and replaced with a new clean bristle pack. The solvent can be either a petroleum distilled solvent, used for removing oil base paint, or water which can be used to remove latex base paint.

Figure 21:
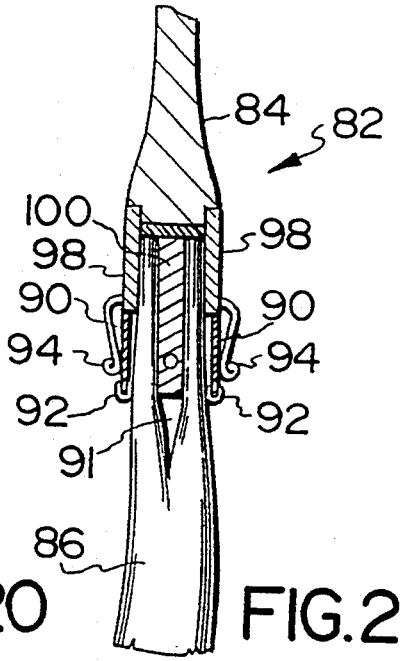
FIG. 21 illustrates an end section view of the removable bristle pack and bristle holder with the side gripping plates hinged against the bristles.

FIG. 21 illustrates a section end view of the interior of the brush, with the two hinged panels 90 closed so that they abut the respective sides of the removable bristle pack 86 and hold it in place so that the paint brush 82 can be used. The pair of reinforcing clips 92, which are formed of hardened steel, ensure that the two panels 90, when abutting the sides of the bristles, squeeze the bristles 86 tightly against bristle separator 100, thereby discouraging paint from migrating along the bristles 86 past the point where the pair of reinforcing clips 92 abut the bristles 86. The combination of the reinforcing clips 92 and the bristle separator 100 also serves to hold the two groups of bristles snugly, for painting purposes. Then, once the paint job has been completed, or the painter wishes to stop painting for the day, the painter merely removes the pair of clips 92 away from the pair of panels 90. The hinged panels 90 are then swung away from the bristles, to the position seen in FIG. 20, and the bristles 86 are then fully exposed for ready cleaning. Alternatively, the entire bristle pack 86 can be removed from the holder 98 and cleaned in the solvent, or replaced with a new bristle pack 86.

Tests conducted with the paint brush 82 indicate that the bristle pack 86 can be fully cleaned using only about 10 percent of the amount of solvent normally used. Furthermore, it has been found that because the paint is not allowed to travel to the junctions where the bristles 86 meet the brush handle 84, flex points of bristle weakness are not created, and hence the bristles last much longer than the conventional paint brush designs.

Bristle holder 88, hinged panels 90, and the holder end pieces 98 can be formed of a suitable plastic such as medium density polyethylene, polypropylene, or some other flexible plastic. The joint between the panels 90 and the bristle holder 88, using such plastic materials, can be flexed millions of times. Therefore, a separate hinge is not required. The bristle pack 86 can be constructed of horse hair, or some other suitable bristle material, and the separator 100 can be constructed of a suitable plastic or cardboard.

Figure 22:
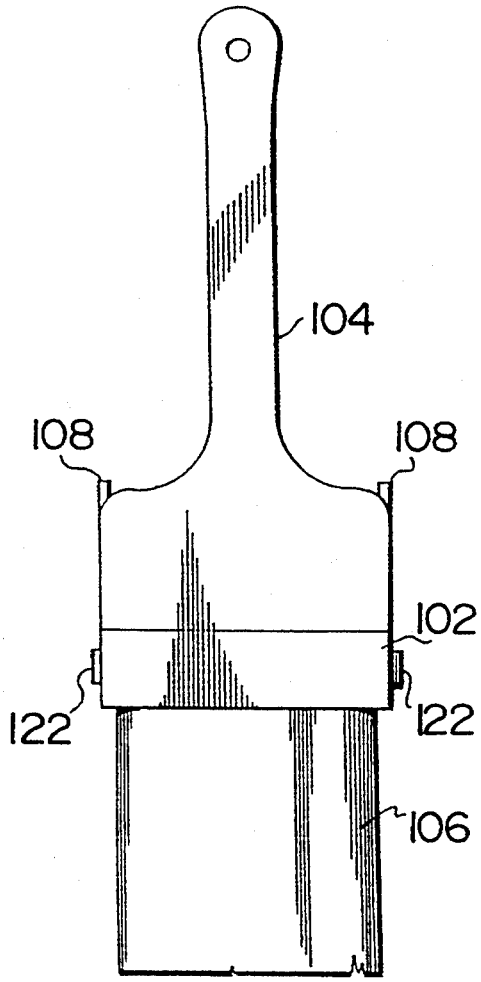
FIG. 22 illustrates a front view of a paint brush with removable bristle pack and an alternative releasable clamp clamped against the bristles.
Figure 23:
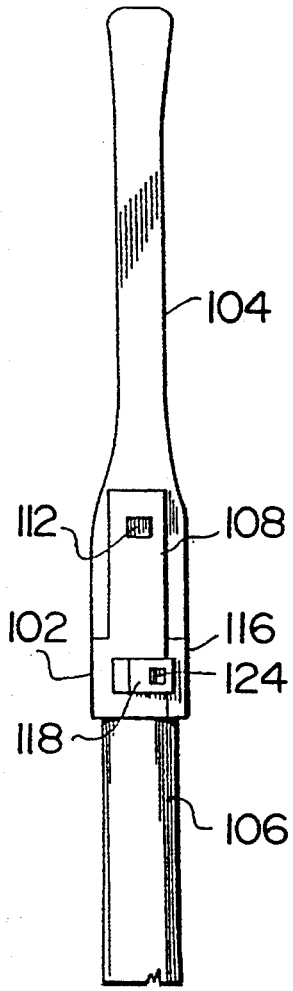
FIG. 23 illustrates an end view of a paint brush with removable bristle pack and an alternative releasable clamp secured in place on the paint brush.
Figure 24:
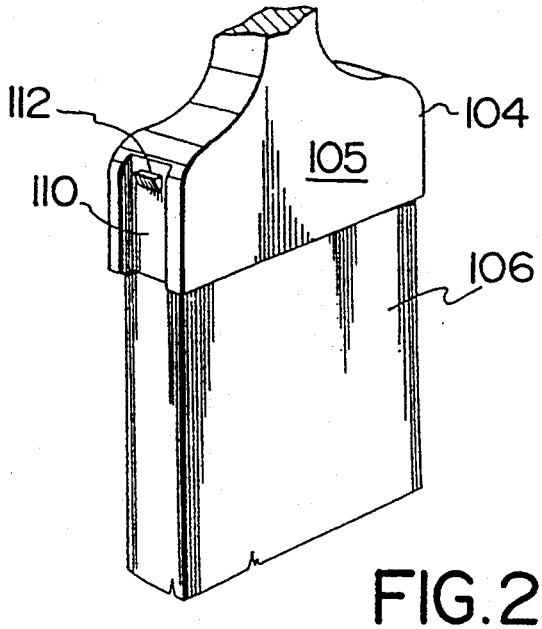
FIG. 24 illustrates a perspective view of a paint brush handle adapted to receive the alternative paint brush bristle clamp, which clamps the removable bristle pack in place.

Referring to FIGS. 22 and 24, which illustrate respectively front and side elevation views of a paint brush, with an alternative paint brush bristle clamp secured in place, it can be seen that the paint brush clamp 102 is positioned on the paint brush 104 over the bristles of the bristle pack 106 in the area where the bristles are set or clamped in the base of the paint brush 104. The clamp 102 has a pair of wing grips 108 which fit onto the sides of the base of the paint brush 104.

Referring to FIG. 24, it can be seen that the base 105 of the paint brush 104 is adapted to have grip slots 110 formed on each side. Each grip slot 110 has a grip prong 112 constructed at the top end of the respective grip slot 110. The bottom end of the base 105 is open and is adapted to receive the removable bristle pack 106, including the separator.

Figure 25:
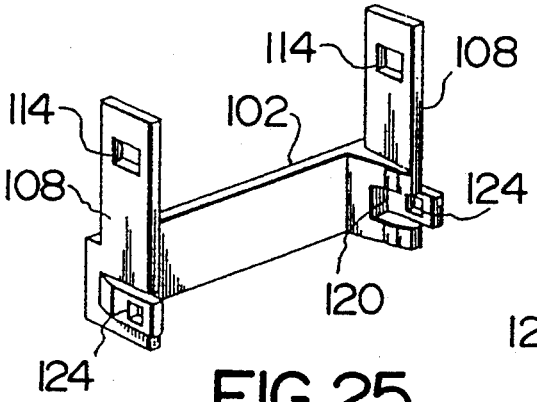
FIG. 25 illustrates a perspective view of the main component of the alternative removable paint brush bristle clamp.

Referring to FIG. 25, which illustrates in perspective view the main component of the clamp 102, it can be seen that the clamp 102 has the respective wing grips 108 constructed at each side of the clamp 102. Prong holes 114 are constructed at the top region of each of the wing grips 108. Prong holes 114 respectively receive the two grip prongs 112, which are constructed in the top regions of the two grip slots 110 on each side of the base 105.

Figure 26:
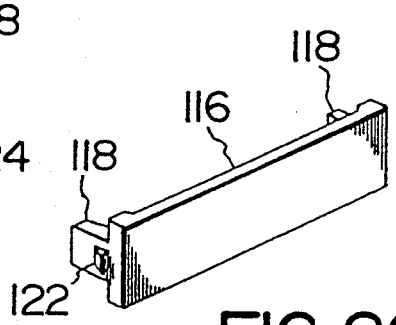
FIG. 26 illustrates a perspective view of the removable element of the alternative removable paint brush bristle clamp.

As can be seen in perspective view in FIG. 26, removable clamp piece 116 is constructed so that it has a pair of clamp grips 118 formed at each end of the clamp piece 116. These clamp grips 118 are formed to mate with a respective pair of clamp grip slots 120 which are constructed in the interior surfaces of the two sides of the clamp 102. Each clamp grip 118 has a clamp grip prong 122, formed on the outer side of each clamp grip 118. These prongs 122 are adapted to be received within and held by a pair of clamp prong holes 124, which are formed in the outer sides of the respective clamp grip slots 120 in clamp 102. Thus removable clamp piece 116 can be snapped into place in conjunction with clamp 102 by inserting the respective clamp grips 118 into the respective clamp grip slots 120 and having the prongs 122 snap into place within respective prong holes 124.

The clamp 102 is first secured to the base 105 of the paint brush 104 by sliding respective wing grips 108 into respective side grip slots 110 as formed on the sides of the base 105. The wing grips 108 are slid along the slots, in an upwardly direction, commencing at the base of each slot 110, until a point is reached where grip prongs 112 snap into position in respective prong holes 114. Then, once clamp 102 is in place, and in effect encloses three sides of the bristles 106, removable clamp piece 116 is put into place by inserting the respective clamp grips 118 into respective slots 120 of the clamp 102, until a point is reached where the respective prongs 122 snap into place within the respective prong holes 124. Once these procedures have been completed, the clamp 102, with clamp piece 116 in place, is securely fastened onto the base 105 of paint brush 104.

Figure 27:
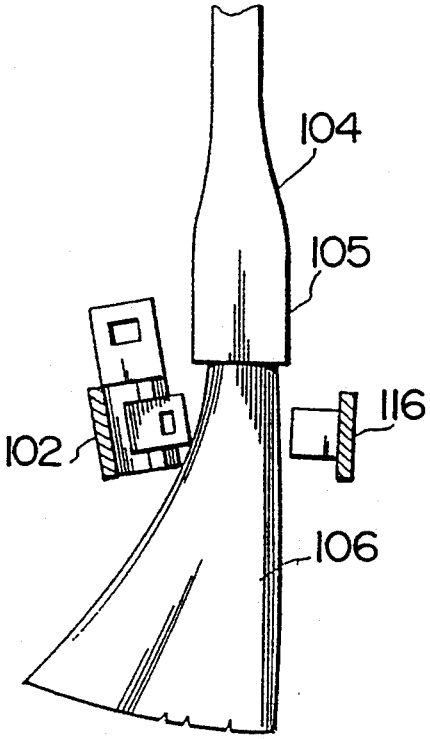
FIG. 27 illustrates a side section view of a paint brush, with the two alternative removable bristle clamp members in a position ready for-clamping on the paint brush to hold the removable bristle pack in place.

FIG. 27 illustrates by section end view the manner in which the clamp 102 and the removable clamp 116 fit securely over the top end of removable bristle pack 106, and immediately below base 105 of paint brush 104. With clamp piece 116 in place, clamp 102 by being securely fixed at the top region of the bristle pack 106, prevents wet paint from migrating by capillary action upwardly between the bristles that are held under the clamp 102/clamp piece 116 combination. As can be seen in FIG. 27, with the clamp in place, ample bristle 106 length remains to enable the paint brush to be used for painting. Once the user is through with the paint brush for the day, the painter merely removes the combination of clamp 102/piece 116 from the brush, and then using solvent, cleans away unused paint from the bristles 106. Because the wet paint has not been permitted to migrate to the very top ends of the bristles 106, the paint is much more easily cleaned away from that area. The effect of this is that any clogged paint at the top region of the bristles is easily cleaned away by the solvent.

The clamp 102/piece 116 combination has a number of advantages. Once the clamp has been removed, less time is required to clean the bristles of unused wet paint. Moreover, the bristles are easier to clean since the paint is located in the region of the paint bristles removed from the base 105. Because the clamp 102/piece 116 combination prevents the build-up of paint in the region where the bristles 106 are set into the base 105, bristle flare is prevented and bristles last longer, thereby prolonging the life of the paint brush. Furthermore, less solvent is required to clean the paint brush, thereby representing a savings in solvent cost. The use of the clamp 102/piece 116 combination also causes the performance of the paint brush to be more consistent over a longer period of time.

A longstanding problem with conventional paint brushes is that the performance of the paint brush is proportionally reduced with the build-up of clogged dry paint at the base regions of the bristles. This does not occur when the clamp 102/piece 116 combination is used. The clamp 102/piece 116 combination can be constructed of lightweight materials such as a strong plastic, aluminum, or some other suitable material, and thus the weight and size of the paint brush is not appreciably affected. The clamp 102/piece 116 combination can be manufactured in different sizes, shapes, and of different materials, to accommodate different sizes of paint brushes, for example, 1½ inch, 2 inch, 3 inch, 4 inch, and other commercial sizes. The clamp 102/clamp piece 116 combination can be used on any type of paint brush, including pig's bristle paint brushes, nylon fibre paint brushes, and others available on the marketplace.

Figure 28:
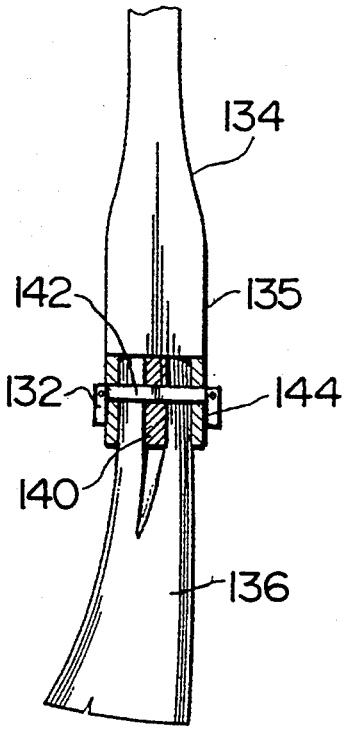
FIG. 28 illustrates a side section view of the removable bristle pack of the paint brush set into the paint brush handle, and held in place by a removable pin.

FIG. 28 illustrates in end section-view an embodiment of the paint brush 134 with base 135 and removable bristle pack 136. The base 135 has a bristle pack retaining section 132 which encloses the top ends of the bristles and the mid-section 140. As seen in FIG. 28, a removable pin 142 with hinged end pieces 144 (see also FIG. 4) extends through the retaining section 132, the top end of the bristles and the mid-section 140 to hold the removable bristle pack in place in the brush base 135. The pin 142 can be withdrawn from the retainer 132 by lifting one of the end pieces 144 so that it aligns with the pin and will slide through the holes in the retainer 132. The bristle pack 136 can then be removed.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A unitary paint brush with replaceable bristles comprising:

(a) a paint brush body having a first end and a second end, and a first side and a second side, and a handle connected to the first end of the body, the body having formed in the second end thereof opposite the handle a cavity for receiving one end of a group of bristles;

(b) a group of bristles held together and having a first end which is received in the cavity, and a second free end which protrudes from the cavity;

(c) a pair of hinged releasable members secured respectively to the first and second sides of the paint brush body, and projecting over the cavity, the pair of hinged releasable members abutting the bristles at a point between the first end and the second free end of the bristles when moved to a first closed position, and being spaced from the bristles when moved to a second open position, the first end of said bristle group being secured in place in the cavity by the pair of hinged releasable members when in the first closed position, and the first end of said bristle group being removable from the cavity when the pair of hinged releasable members are in the second open position; and (d) at least one securing means for securing the pair of hinged releasable members in the first closed position and releasing the pair of hinged releasable members for movement to the second open position.

2. A paint brush as claimed in claim 1 wherein the pair of hinged releasable members are elongated planar flaps with opposite faces and a respective hinged side and a free side, said flaps being hinged along respective hinged sides to the first and second sides of the body, adjacent the cavity, and the at least one securing means are a pair of securing means.

3. A paint brush as claimed in claim 2 wherein the free sides of the respective planar flaps have reinforcing clips secured thereto.

4. A paint brush as claimed in claim 2 wherein the first and second sides of the body have end flaps protruding therefrom on opposite sides of the cavity, and the pair of hinged releasable flaps have connectors which enable the pair of hinged releasable flaps to be releasably connected with the pair of end flaps which are located between the pair of hinged releasable flaps when the pair of hinged releasable flaps are in the closed position.

5. A paint brush as claimed in claim 3 wherein the securing means are springs which pivot relative to the pair of flaps, and when pivoted to a first position, close the flaps against the bristles, and when pivoted to a second open position, enable the flaps to be moved away from the bristles.

6. A paint brush as claimed in claim 5 wherein a bristle separator which separates the bristles into two groups is located in the cavity between the pair of hinged releasable members.

7. A paint brush as claimed in claim 6 wherein the bristle separator and the bristles are secured within the cavity by a removable pin.

8. A paint brush as claimed in claim 6 wherein the bristle separator and the first end of the bristles group are glued together and are held in the interior of the cavity.

9. A paint brush as claimed in claim 8 wherein the bristle separator has two sides, two ends and two faces, and a series of openings are disposed along one side thereof, said openings being adapted to enable glue to pass from one face of the bristle separator to the other face of the bristle separator, and hold the separator in place in the cavity.

10. A paint brash as claimed in claim 8 wherein the cavity has a pair of side walls and a pair of end walls and the bristle separator is secured to the respective end walls of the cavity between the respective hinged releasable members.

11. A paint brush as claimed in claim 10 wherein the separator is removably connected to the body of the paint brush by at least one tongue on one of the separator and the body, and a corresponding groove on the other of the separator and the body.

12. A paint brush as claimed in claim 10 wherein the bristle separator has a rectangular shape with two sides, two ends and two faces and a series of openings are disposed along one side thereof, said openings being adapted to enable glue to pass from one face of the bristle separator to the other face of the bristle separator, and hold the separator in place in the cavity.

13. A paint brush as claimed in claim 12 wherein a hook is installed in the body of the paint brush, the hook being adapted to enable the paint brush to be hooked onto a paint can.

14. A paint brush as claimed in claim 12 wherein the movable securing means are metal springs.

15. A paint brush with replaceable bristles comprising:

(a) a paint brush body having a first end and a second end, and a first side and a second side, and a handle connected to the first end of the body, the body having formed in the second end thereof opposite the handle a cavity for receiving an end of a group of bristles;

(b) a pair of hinged releasable members which are elongated planar flaps having sides and ends, which flaps are respectively hinged along one side to the body adjacent the cavity, the pair of hinged releasable members abutting the bristles when moved to a first closed position, and being separated from the bristles when moved to a second open position;

(c) at least one moveable securing means for securing the pair of hinged releasable members in the first closed position and releasing the pair of hinged releasable members for movement to the second open position; and (d) a group of parallel bristles having a first and second free end, the first end being held together, the second free end projecting from the cavity, the first end of the bristles being located within the cavity and held in place by the pair of hinged releasable members in the first closed position, said first end of the bristle group being removable from the cavity by releasing at least one of the pair of hinged releasable members to the second open position.

* * * * *